US010971056B2

(12) United States Patent
Matoba et al.

(10) Patent No.: US 10,971,056 B2
(45) Date of Patent: Apr. 6, 2021

(54) DISPLAY DEVICE

(71) Applicant: Mitsubishi Electric Corporation, Tokyo (JP)

(72) Inventors: Takashi Matoba, Tokyo (JP); Shigenori Shibue, Tokyo (JP); Yoshinori Asamura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/311,642

(22) PCT Filed: Jan. 12, 2018

(86) PCT No.: PCT/JP2018/000669
§ 371 (c)(1),
(2) Date: Dec. 19, 2018

(87) PCT Pub. No.: WO2019/138543
PCT Pub. Date: Jul. 18, 2019

(65) Prior Publication Data

US 2020/0380909 A1 Dec. 3, 2020

(51) Int. Cl.
*G09G 3/32* (2016.01)
*G09G 3/20* (2006.01)
*G09G 5/14* (2006.01)

(52) U.S. Cl.
CPC ..... *G09G 3/32* (2013.01); *G09G 3/2003* (2013.01); *G09G 5/14* (2013.01);
(Continued)

(58) Field of Classification Search
CPC ..... G09G 5/006; G09G 5/003; G09G 5/14; G09G 2320/0686; G09G 2320/0271;
(Continued)

(56) References Cited

U.S. PATENT DOCUMENTS

2004/0201582 A1* 10/2004 Mizukoshi ..... G09G 3/3291 345/211
2006/0087502 A1 4/2006 Karidis et al.
(Continued)

FOREIGN PATENT DOCUMENTS

JP 2004-309810 A 11/2004
JP 2017-45030 A 3/2017
JP 2017-111345 A 6/2017

OTHER PUBLICATIONS

Extended European Search Report issued in corresponding European Application No. 18842765.2 dated Sep. 23, 2019.
(Continued)

*Primary Examiner* — Christopher E Leiby
(74) *Attorney, Agent, or Firm* — Birch, Stewart, Kolasch & Birch, LLP

(57) ABSTRACT

Provided is a display device that individually corrects luminance of an image to be displayed in a part of an image display area and an image to be displayed in the other area. The display device includes a display unit to display an entire image, and a luminance correction controller to correct luminance of the entire image. The entire image is an image in which a first image displayed in a first display area being an area except a second display area is superimposed by a second image displayed in the second display area that is set in a part of the image display area. The luminance correction controller respectively corrects the luminance of the first and second images by using the first and second luminance correction coefficients. The display unit displays first and the second images each having corrected luminance respectively in the first and second display areas.

6 Claims, 8 Drawing Sheets

(52) U.S. Cl.
CPC ..... *G09G 2320/064* (2013.01); *G09G 2320/0686* (2013.01); *G09G 2330/023* (2013.01); *G09G 2340/12* (2013.01); *G09G 2360/16* (2013.01)

(58) Field of Classification Search
CPC ..... G09G 2320/066; G09G 2320/064; G09G 2360/16; G09G 2330/021; G09G 2330/023; G09G 3/32; G09G 3/2003; G09G 2340/12
See application file for complete search history.

(56) References Cited

U.S. PATENT DOCUMENTS

| | | | | |
|---|---|---|---|---|
| 2006/0227125 | A1 | 10/2006 | Wong et al. | |
| 2009/0244048 | A1* | 10/2009 | Yamanaka | G09G 3/007 345/212 |
| 2016/0314762 | A1 | 10/2016 | Lee et al. | |
| 2017/0061894 | A1* | 3/2017 | Ikeda | G09G 5/006 |

OTHER PUBLICATIONS

Extended European Search Report, dated Dec. 17, 2019, for European Application No. 18842765.2.
International Search Report for PCT/JP2018/000669 (PCT/ISA/210) dated Apr. 10, 2018.

* cited by examiner

DISPLAY DEVICE

TECHNICAL FIELD

The present invention relates to a display device, and more particularly to a luminance correction control technology for an image displayed by a display device.

BACKGROUND ART

Display devices using light emitting diodes (LEDs) for pixels are often used in indoor and outdoor advertising displays etc. owing to technological development and lowered costs of LEDs. Such display devices have hitherto been mainly used for the purpose of displaying a moving image such as a natural image and animation. In recent years, however, such display devices are used also in indoor displays having a short visible distance, such as a display for a meeting room and a display for displaying a monitored image, as a result of narrowed pixel pitches. Among those indoor display devices, in many cases, monitoring LED display devices display a moving image in a part of a display area and a still image in the most of the other part, as in computer images.

Patent Document 1 discloses a display device for saving power by reducing increase of power supply capacity. The display device disclosed in Patent Document 1 predicts values of current to flow through a display panel, based on an image signal input into the display device. Then, when the sum of the values of current etc. reaches a predetermined threshold value or more per frame, the display device performs image signal processing, specifically, corrects contrast or brightness of the image, to thereby perform control such that the values of current to flow through the display panel do not exceed a predetermined maximum value.

PRIOR ART DOCUMENT

Patent Document

Patent Document 1: Japanese Patent Application Laid-Open No. 2004-309810

SUMMARY

Problem to be Solved by the Invention

In the electrical control performed by the display device disclosed in Patent Document 1, if an image displayed in the display panel is only one image, image quality of the image is deteriorated. In contrast, if an image displayed in the display panel is a superimposed image in which a base image is superimposed by a different image, image quality of both of the base image and the superimposing image is deteriorated depending on power control.

The present invention has been made in order to solve the problems as above, and therefore has an object to provide an image display device capable of performing power-saving control while reducing deterioration of image quality of an image to be displayed in a part of an image display area and an image to be displayed in an area except the part.

Means to Solve the Problem

A display device according to the present invention includes a display unit, and a luminance correction controller. The display unit includes an image display area capable of individually displaying different images in a first display area and a second display area. The second display area is set in a part of the image display area. The first display area is a part of the image display area except the second display area. The display unit displays a first image in the first display area and a second image in the second display area to thereby sequentially display, er frame, an entire image in which the first image is superimposed by the second image in the image display area. The luminance correction controller corrects luminance of the entire image per the frame. The luminance correction controller includes a first luminance information calculator, a second luminance information calculator, a first correction coefficient calculator, a second correction coefficient calculator, a first correction calculator, and a second correction calculator. The first luminance information calculator calculates luminance of the first image. The second luminance information calculator calculates luminance of the second image. The first correction coefficient calculator calculates a first luminance correction coefficient for correcting the luminance of the first image. The second correction coefficient calculator calculates a second luminance correction coefficient for correcting the luminance of the second image. The first correction calculator corrects the luminance of the first image by using the first luminance correction coefficient. The second correction calculator corrects the luminance of the second image by using the second luminance correction coefficient. The display unit displays the first image having the luminance corrected by the first correction calculator in the first display area, and displays the second image having the luminance corrected by the second correction calculator in the second display area.

Effects of the Invention

According to the present invention, it is possible to provide a display device that performs power-saving control while reducing deterioration of image quality of an image to be displayed in a part of an image display area and an image to be displayed in an area except the part.

These and other objects, features, aspects and advantages of the present invention will become more apparent from the following detailed description of the present invention when taken in conjunction with the accompanying drawings.

DESCRIPTION OF EMBODIMENTS

First Embodiment (Configuration of Display Device)

Figure 1:
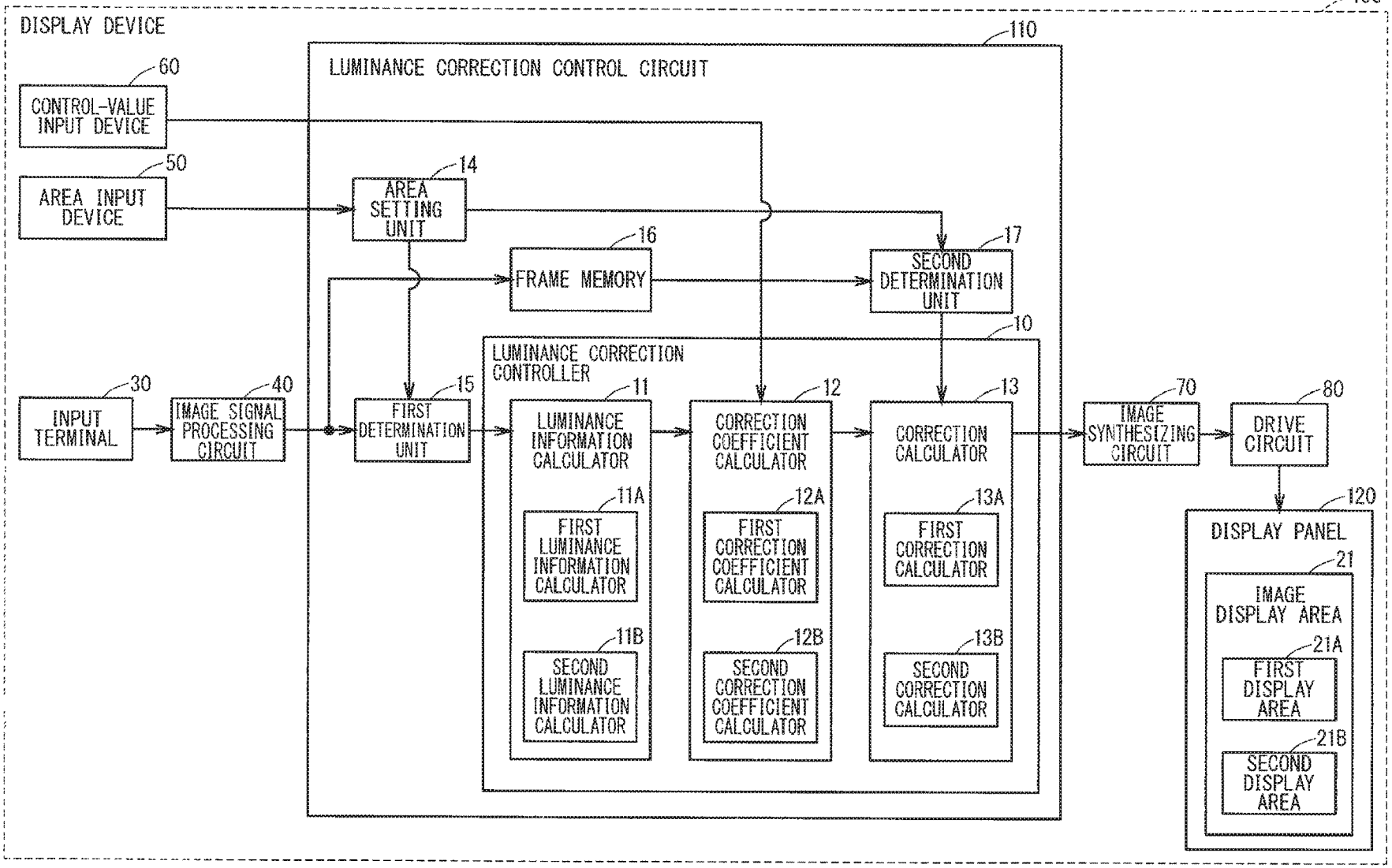
FIG. 1 is a functional block diagram showing configuration of a display device according to a first embodiment.

FIG. 1 is a functional block diagram showing configuration of a display device 100 according to a first embodiment. The display device 100 of the first embodiment includes a display panel 120, an area input device 50, a control-value input device 60, an input terminal 30, an image signal processing circuit 40, a luminance correction control circuit 110, an image synthesizing circuit 70, and a drive circuit 80.

Figure 2:
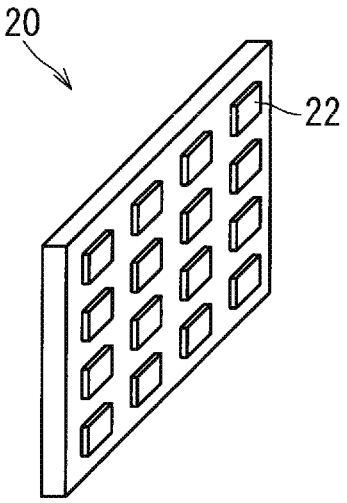
FIG. 2 is a perspective view schematically showing configuration of a display panel according to the first embodiment.

The display panel 120 is a display unit, which sequentially displays, per frame, an image that is based on an image signal to thereby display images. The display panel 120 has a configuration in which a plurality of pixels are arrayed in a matrix pattern in an image display area 21. FIG. 2 is a perspective view schematically showing configuration of the display panel 120 according to the first embodiment. FIG. 2 exemplifies a display panel 120 consisting of 4 pixels×4 pixels=16 pixels. Each of pixels 22 has a pixel value, and the pixel value corresponds to a gradation of luminance of an image that is based on an image signal. In the first embodiment, the display panel 120 is an LED display panel, and an individual pixel 22 consists of a combination of three LEDs emitting different respective colors of red (R), green (G), and blue (B). The three LEDs of the pixel 22 each have a pixel value as well. The LED display device including an LED display panel described in the first embodiment is one example of a display device, and embodiment of the display device is not limited thereto.

Figure 3:
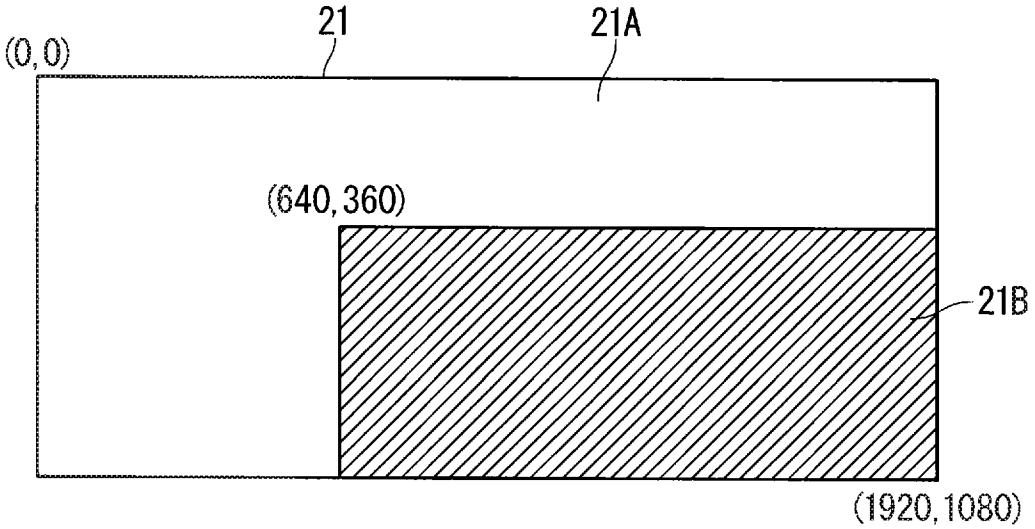
FIG. 3 is a diagram showing configuration of an image display area of the display panel according to the first embodiment.

FIG. 3 is a diagram showing configuration of the image display area 21 of the display panel 120 according to the first embodiment. The display panel 120 includes the image display area 21 having input resolution of 1920 pixels×1080 pixels. That is, the display panel 120 consists of LEDs in the number corresponding to 1920 LED combinations×1080 LED combinations. The image display area 21 includes a first display area 21A for displaying a base image, and a second display area 21B for displaying a superimposing image. The second display area 21B is set in a part of the image display area 21. For example, referring to the coordinates to represent positions in the image display area 21 shown in FIG. 3, an area having (640, 360) and (1920, 1080) at opposite angles is the second display area 21B. Further, the first display area 21A is an area in the image display area 21 except the second display area 21B. The first display area 21A and the second display area 21B can individually display different images. The display panel 120 displays a first image in the first display area 21A, and displays a second image in the second display area 21B. For example, the display panel 120 displays a still image in the first display area 21A, and displays a moving image in the second display area 21B. The display panel 120 sequentially displays an entire image, in which a first image is superimposed by a second image, in the image display area 21 per frame.

The area input device 50 shown in FIG. 1 is an input device for a user to designate the second display area 21B. Via the area input device 50, a user can designate a desired area in the image display area 21 as the second display area 21B. For example, the user inputs positional information, such as coordinates, of the desired area, to thereby designate the second display area 21B.

The control-value input device 60 is an input device for inputting a control value relating to luminance correction control when the display device 100 performs power-saving operation. In the first embodiment, maximum power and a lower-limit value of luminance of the second display area 21B of a case when the display device performs power-saving operation are input into the control-value input device 60. These values are input into the control-value input device 60 by a user.

The input terminal 30 is a terminal for receiving an image signal. The image signal is input into the input terminal 30. The image signal includes a first image signal for displaying a first image, and a second image signal for displaying a second image.

The image signal processing circuit 40 performs processing, such as gamma correction, on an image that is based on the input image signal.

The luminance correction control circuit 110 includes an area setting unit 14, a first determination unit 15, a luminance correction controller 10, a frame memory 16, and a second determination unit 17.

The area setting unit 14 sets an area designated by the area input device 50 as the second display area 21B.

The first determination unit 15 determines whether an incoming image signal entering via the image signal processing circuit 40 is the first image signal for displaying a first image in the first display area 21A or the second image signal for displaying a second image in the second display area 21B, based on positional information of the second display area 21B that is output from the area setting unit 14. Note that, the second display area 21B may be a predetermined area. In such a case, the area input device 50 and the area setting unit 14 need not be provided in the display device 100. The first determination unit 15 reads positional information of a predetermined second display area 21B that is previously stored in a memory or the like, and then performs the above determination operation.

The luminance correction controller 10 includes a luminance information calculator 11, a correction coefficient calculator 12, and a correction calculator 13. The luminance correction controller 10 corrects luminance of the entire image to be displayed in the image display area 21 per frame. That is, the luminance correction controller 10 corrects, per frame, luminance of the first image and luminance of the second image each based on an image signal, or a dynamic range.

The luminance information calculator 11 individually calculates luminance of each of the first image to be displayed in the first display area 21A and the second image to be displayed in the second display area 21B. The luminance information calculator 11 includes a first luminance information calculator 11A and a second luminance information calculator 11B. The first luminance information calculator 11A calculates luminance of the first image based on a determination result output by the first determination unit 15. That is, the first luminance information calculator 11A calculates luminance information of the first display area 21A based on a first image signal. The luminance information to be calculated by the first luminance information calculator 11A is, for example, the sum of pixel values of a case when the pixels 22 included in the first display area 21A display the first image. The second luminance information calculator 11B calculates luminance of the second image based on a determination result output by the first determination unit 15. That is, the second luminance information calculator 11B calculates luminance information of the second display area 21B based on a second image signal. The luminance information to be calculated by the second luminance information calculator 11B is, for example, the sum of pixel values of a case when the pixels 22 included in the second display area 21B display the second image.

The correction coefficient calculator 12 calculates a luminance correction coefficient for individually correcting luminance of each of the first image to be displayed in the first display area 21A and the second image to be displayed in the second display area 21B. The correction coefficient calculator 12 includes a first correction coefficient calculator 12A and a second correction coefficient calculator 12B. The first correction coefficient calculator 12A calculates a first luminance correction coefficient for correcting luminance of the first image, based on the luminance information output by the first luminance information calculator 11A. The second correction coefficient calculator 12B calculates a second luminance correction coefficient for correcting luminance of the second image, based on the luminance information output by the second luminance information calculator 11B.

The frame memory 16 stores, per frame, the image signal that is input into the input terminal 30 and is output from the image signal processing circuit 40, and outputs, per frame, the stored image signal at a timing requested by the drive circuit 80 to be described later. The image signal is input into the input terminal 30 in accordance with vertical and horizontal synchronization signals. The drive circuit 80 that drives the display panel 120, by contrast, performs control at a timing very different from the vertical and horizontal synchronization signals for the image signal. The frame memory 16 outputs the image signal per frame in accordance with a timing requested by the drive circuit 80. Accordingly, an image signal delayed by one frame is output from the frame memory 16.

The second determination unit 17 determines whether an image signal output from the frame memory 16 to enter the second determination unit 17 is the first image signal or the second image signal, based on positional information of the second display area 21B that is output from the area setting unit 14. In accordance with the determination result, the second determination unit 17 outputs the first image signal to the first correction calculator 13A, and the second image signal to the second correction calculator 13B.

The correction calculator 13 individually corrects luminance of each of the first image to be displayed in the first display area 21A and the second image to be displayed in the second display area 21B. The correction calculator 13 includes a first correction calculator 13A and a second correction calculator 13B. The first correction calculator 13A corrects the first image signal output from the second determination unit 17 by using the first luminance correction coefficient calculated by the first correction coefficient calculator 12A. For example, the first correction calculator 13A multiplies a luminance signal contained in the first image signal by the first luminance correction coefficient. The luminance signal is, for example, a pixel value of a case when each pixel 22 included in the first display area 21A displays a first image. The first image signal, after luminance of the first image thereof is corrected, is output to the image synthesizing circuit 70. The second correction calculator 13B corrects the second image signal output from the second determination unit 17 by using the second luminance correction coefficient calculated by the second correction coefficient calculator 12B. For example, the second correction calculator 13B multiplies a luminance signal contained in the second image signal by the second luminance correction coefficient. The luminance signal is, for example, a pixel value of a case when each pixel 22 included in the second display area 21B displays a second image. The second image signal, after luminance of the second image thereof is corrected, is output to the image synthesizing circuit 70.

The correction coefficient calculator 12 of the luminance correction controller 10 described above calculates the sum of pixel values of the pixels 22 included in the respective display areas. Therefore, one frame of an image signal needs to be input so as to complete the calculation carried out by the correction coefficient calculator 12. Consequently, a delay corresponding to one frame occurs before the ultimate calculation result is reached. An image signal, by contrast, is output from the frame memory 16 at a timing requested by the drive circuit 80, and therefore a delay corresponding to one frame occurs herein. Thus, the first correction calculator 13A and the second correction calculator 13B can respectively correct luminance of the first image and luminance of the second image in the identical frame where the first luminance correction coefficient and the second luminance correction coefficient are calculated.

The image synthesizing circuit 70 produces a synthesized image signal, in which the first image signal for displaying a first image having corrected luminance and the second image signal for displaying a second image having corrected luminance are image-synthesized. At this time, a display position of the second image in the image display area 21 is determined based on the positional information of the second display area 21B output from the area setting unit 14.

The drive circuit 80 outputs a drive signal for driving the display panel 120 to the display panel 120, based on the synthesized image signal output from the image synthesizing circuit 70. Based on the drive signal, the display panel 120 displays a synthesized image in the image display area 21.

(Luminance Control Method Using PWM)

Figure 4:
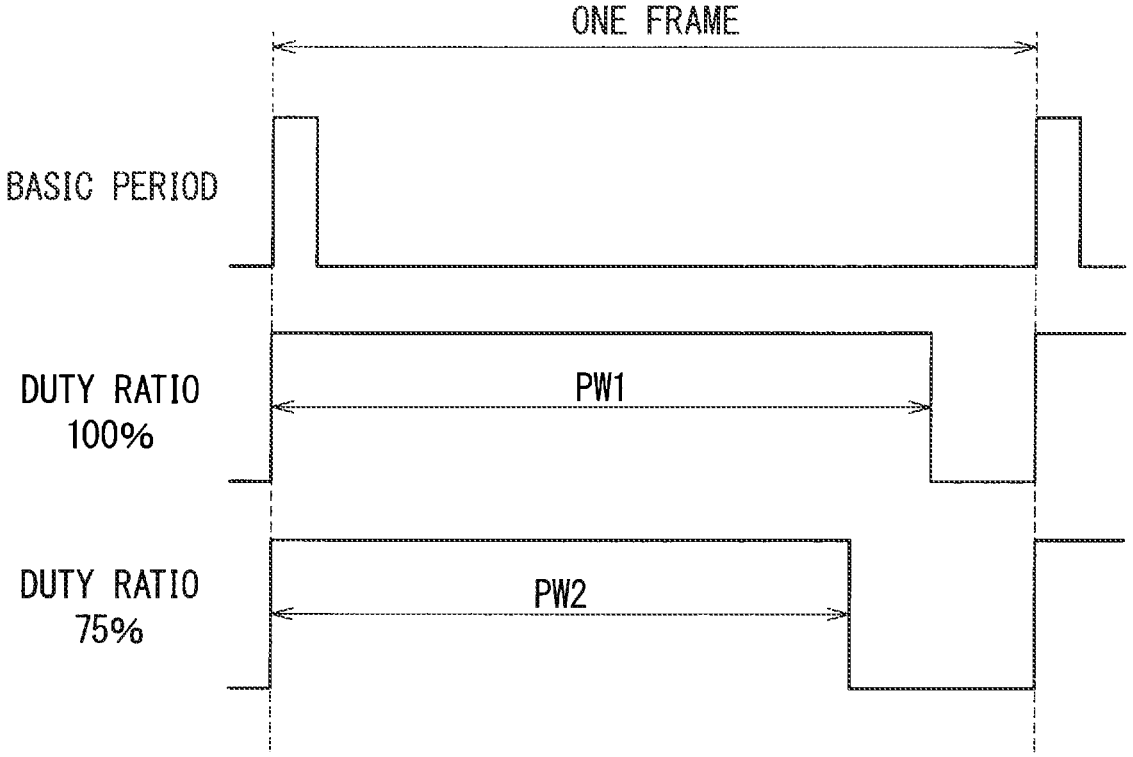
FIG. 4 is a timing chart showing one example of pulse width modulation (PWM) drive according to the first embodiment.

A luminance adjusting method employed when the display device 100 displays an image in the display panel 120 will be described. The drive circuit 80 of the display device 100 according to the first embodiment adjusts luminance by driving the display panel 120 with a pulse width modulation (PWM) method. FIG. 4 is a timing chart showing one example of PWM drive according to the first embodiment. FIG. 4 contains three charts. The uppermost chart shows one frame of an image signal representing a basic period of PWM. The middle chart shows an example of a current pulse width PW1, which allows the drive circuit 80 to be electrically connected to LEDs. A duty ratio of the current pulse width PW1 is 100%, and is equal to or less than a period of one frame of an image signal. The lowermost chart shows an example of a current pulse width PW2. The current pulse width PW2 has a duty ratio of 75%. PWM drive using the current pulse width PW2 has a duty ratio smaller than that of PWM drive using the current pulse width PW1. A time period of electrical connection to LEDs in one frame is shorter, and luminance thereof is accordingly lower. The display device 100 adjusts luminance of each LED by changing a duty ratio of a current pulse width in one frame. Further, PWM drive using the current pulse width PW2 has a time period of electrical connection to LEDs shorter than that of PWM drive using the current pulse width PW1, and accordingly has smaller power consumption. In this manner, the value of the duty ratio of PWM drive is relative to luminance and the amount of power consumption. Thus, as a luminance value of an image signal is smaller, a duty ratio is smaller and power consumption of LEDs is smaller.

Conversely, as a luminance value of an image signal is larger, a duty ratio is larger and power consumption of LEDs is larger. Power consumption in the PWM drive having a duty ratio of 75% corresponds to 75% of power consumption in the PWM drive having a duty ratio of 100%.

(Luminance Correction Control)

Figure 5:
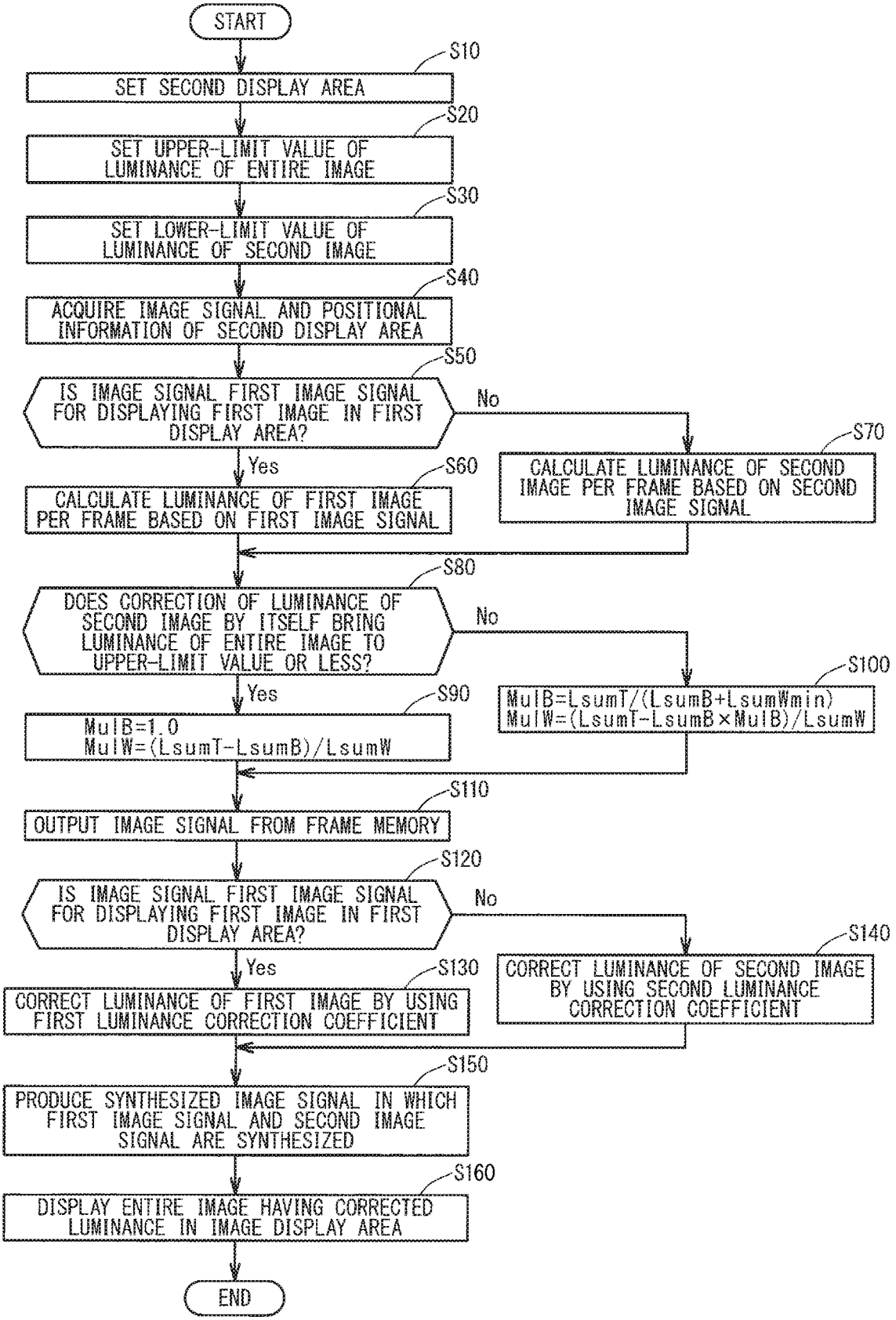
FIG. 5 is a flowchart showing luminance correction control of the display device according to the first embodiment.

FIG. 5 is a flowchart showing luminance correction control of the display device 100 according to the first embodiment. In the following, operation of the luminance correction control will be described with reference to the block diagram shown in FIG. 1 and the flowchart shown in FIG. 5. In the first embodiment, the first correction calculator 13A and the second correction calculator 13B multiply an image signal by the first luminance correction coefficient and the second luminance correction coefficient, respectively, so as to correct each luminance. Thus, the first luminance correction coefficient and the second luminance correction coefficient each have a value equal to or less than 1.0.

In Step S10, the area setting unit 14 sets the second display area 21B. At this time, positional information of the second display area 21B is input into the area input device 50. For example, via the area input device 50, a user designates an area in the image display area 21 where the second image is to be displayed in superimposition. The area input device 50 outputs the designated positional information to the area setting unit 14. The area setting unit 14 sets the designated area as the second display area 21B. Further, the area setting unit 14 outputs the positional information of the second display area 21B to the first determination unit 15 and the second determination unit 17.

In Step S20, an upper-limit value of luminance of the entire image to be displayed in the image display area 21 is set. The upper-limit value is input into the control-value input device 60 by the user. As the upper-limit value of luminance of the entire image, for example, an upper-limit value of the sum of pixel values of LEDs included in the image display area 21 is set. The upper-limit value of the sum is hereinafter represented by LsumT. The upper-limit value of luminance of the entire image corresponds to maximum power consumed by the display device 100. As described above, as luminance of an image is larger, power consumed by LEDs is larger. That is, in this Step S20, the display device 100 sets maximum power of a case when the display device 100 performs power-saving operation based on luminance information of the entire image.

In Step S30, a lower-limit value of luminance of the second image is set. In the following steps, if the correction of the luminance of the second image is excessive, clipping occurs in output gradation, causing visual problems depending on images. Such problems can be avoided by setting a lower limit in the luminance of the second image. The lower-limit value of luminance of the second image is input into the control-value input device 60 by a user. In the first embodiment, the user inputs a lower-limit value of the second luminance correction coefficient as a lower-limit value of luminance of the second image. The lower-limit value of the second luminance correction coefficient is hereinafter represented by MulWmin. The second correction coefficient calculator 12B calculates a lower-limit value of luminance of the second image, based on the lower-limit value of the second luminance correction coefficient. If a pixel value of each LED of a case when the second image is displayed in the second display area 21B is the maximum, that is, if a pixel value of each of R, G, and B is 255, a value obtained by multiplying the sum of the pixel values by the lower-limit value of the second luminance correction coefficient is determined to be the lower-limit value of the luminance of the second image. The lower-limit value of luminance of the second image is hereinafter represented by LsumWmin.

In Step S40, the first determination unit 15 receives an image signal that includes the first image signal and the second image signal and is output from the image signal processing circuit 40, and acquires positional information of the second display area 21B output from the area setting unit 14. In this case, the image signal processing circuit 40 receives an image signal via the input terminal 30, and outputs the image signal to the first determination unit 15 and the frame memory 16.

In Step S50, the first determination unit 15 determines whether or not the image signal is the first image signal for displaying a first image in the first display area 21A, based on the positional information of the second display area 21B. The positional information of the second display area 21B is a value output by the area setting unit 14 in Step S10. If the image signal is the first image signal, the first determination unit 15 outputs the first image signal as well as the determination result to the first luminance information calculator 11A. Subsequently, Step S60 is executed. If the image signal is not the first image signal, that is, if the image signal is the second image signal in this case, the first determination unit 15 outputs the second image signal as well as the determination result to the second luminance information calculator 11B. Subsequently, Step S70 is executed.

In Step S60, the first luminance information calculator 11A calculates, per frame, luminance of the first image based on the first image signal. That is, the first luminance information calculator 11A calculates luminance information in the first display area 21A per frame. In the first embodiment, the luminance information is the sum of pixel values of a case when LEDs included in the first display area 21A display the first image. Each of the LEDs of R, G, and B included in the display device 100 has an 8-bit pixel value, that is, a pixel value having 256 gradations of from 0 to 255. The pixel values of the LEDs of R, G, and B included in the first display area 21A are respectively represented by R1*i*, G1*i*, and B1*i*. The luminance information of the first display area 21A is represented by LsumB. LsumB is calculated according to Formula 1.

[Math 1]

$$LsumB=\Sigma(R1i+B1i+C1i) \quad \text{(Formula 1)}$$

In Step S70, the second luminance information calculator 11B calculates, per frame, luminance of the second image based on the second image signal. That is, the second luminance information calculator 11B calculates luminance information in the second display area 21B per frame. In the first embodiment, the luminance information is the sum of pixel values of a case when LEDs included in the second display area 21B display the second image. The pixel values of the LEDs of R, G, and B included in the second display area 21B are respectively represented by R2*i*, G2*i*, and B2*i*. The luminance information of the second display area 21B is represented by LsumW. LsumW is calculated according to Formula 2.

[Math 2]

$$LsumW=\Sigma(R2i+B2i+C2i) \quad \text{(Formula 2)}$$

In Step S80, the correction coefficient calculator 12 determines whether or not correction of the luminance of the second image by itself brings luminance of the entire image to have the upper-limit value or less. Specifically, the correction coefficient calculator 12 determines whether or not the relationship of Formula 3 below is satisfied. That is, the correction coefficient calculator 12 determines whether or not the sum of the luminance information of the first display area 21A calculated in Step S60 and the lower-limit value of the luminance of the second image set in Step S30 is equal to or less than the upper-limit value of the luminance of the entire image set in Step S20. In other words, the correction coefficient calculator 12 determines whether or not correction of the luminance of the second image by itself enables control such that power does not exceed the maximum power. If the relationship of Formula 3 is satisfied, Step S90 is executed. If the relationship of Formula 3 is not satisfied, Step S100 is executed.

[Math 3]

$$LsumT \geq LsumB + LsumW\min \quad \text{(Formula 3)}$$

In Step S90, the first correction coefficient calculator 12A sets the first luminance correction coefficient to 1.0 as in Formula 4. The first luminance correction coefficient is hereinafter represented by MulB. Further, the second correction coefficient calculator 12B calculates a second luminance correction coefficient according to Formula 5. The second luminance correction coefficient is hereinafter represented by MulW. If the second luminance correction coefficient calculated according to Formula 5 is greater than 1.0, the second correction coefficient calculator 12B sets the second luminance correction coefficient to 1.0.

[Math 4]

$$\mathrm{Mul}B = 1.0 \quad \text{(Formula 4)}$$

[Math 5]

$$\mathrm{Mul}W = (LsumT - LsumB)/LsumW \quad \text{(Formula 5)}$$

In Step S100, the first correction coefficient calculator 12A calculates a first luminance correction coefficient according to Formula 6. Further, the second correction coefficient calculator 12B calculates a second luminance correction coefficient according to Formula 7.

[Math 6]

$$\mathrm{Mul}B = LsumT/(LsumB + LsumW\min) \quad \text{(Formula 6)}$$

[Math 7]

$$\mathrm{Mul}W = (LsumT - LsumB \times \mathrm{Mul}B)/LsumW \quad \text{(Formula 7)}$$

In Steps S90 and S100, the first correction coefficient calculator 12A and the second correction coefficient calculator 12B respectively calculate the first luminance correction coefficient and the second luminance correction coefficient per frame. That is, the first luminance correction coefficient and the second luminance correction coefficient are controlled to be updated per frame. One frame of an image signal is needed to calculate the first luminance correction coefficient and the second luminance correction coefficient, and thus a delay corresponding to one frame occurs before the ultimate calculation result is reached.

In Step S110, the frame memory 16 outputs the image signal to the second determination unit 17. The image signal output from the image signal processing circuit 40 is stored in the frame memory 16 in accordance with horizontal and vertical synchronization signals for the image signal in Step S40. The image signal stored in the frame memory 16 is read at a timing requested by the drive circuit 80. In the first embodiment, the image signal stored in the frame memory 16 is read with an interval of one frame after being stored, and is output to the second determination unit 17.

In Step S120, the second determination unit 17 determines whether or not the image signal output from the frame memory 16 is the first image signal for displaying a first image in the first display area 21A, based on the positional information of the second display area 21B. The positional information of the second display area 21B is a value output by the area setting unit 14 in Step S10. If the image signal is the first image signal, the second determination unit 17 outputs the first image signal as well as the determination result to the first correction calculator 13A. Subsequently, Step S130 is executed. If the image signal is not the first image signal, that is, if the image signal is the second image signal in this case, the second determination unit 17 outputs the second image signal as well as the determination result to the second correction calculator 13B. Subsequently, Step S140 is executed.

In Step S130, the first correction calculator 13A corrects luminance of the first image based on the first image signal by using the first luminance correction coefficient. That is, the first correction calculator 13A multiplies the first image signal output from the frame memory 16 by the first luminance correction coefficient calculated by the first correction coefficient calculator 12A. In the first embodiment, the first image signal multiplied by the first luminance correction coefficient in the first correction calculator 13A corresponds to a luminance signal contained in the first image signal, or to image data relating to luminance for display of the first image. As one example, the first correction calculator 13A multiplies each pixel value of a case of displaying the first image by the first luminance correction coefficient.

In Step S140, the second correction calculator 13B corrects luminance of the second image based on the second image signal by using the second luminance correction coefficient. That is, the second correction calculator 13B multiplies the second image signal output from the frame memory 16 by the second luminance correction coefficient calculated by the second correction coefficient calculator 12B. In the first embodiment, the second image signal multiplied by the second luminance correction coefficient in the second correction calculator 13B corresponds to a luminance signal contained in the second image signal, or to image data relating to luminance for display of the second image. As one example, the second correction calculator 13B multiplies each pixel value of a case of displaying the second image by the second luminance correction coefficient.

In Step S150, the image synthesizing circuit 70 produces a synthesized image signal, in which the first image signal for displaying the first image having corrected luminance and the second image signal for displaying the second image having corrected luminance are synthesized. The image synthesizing circuit 70 outputs the synthesized image signal to the drive circuit 80 as a control signal. That is, the image synthesizing circuit 70 outputs, to the drive circuit 80, a control signal for allowing the display panel 120 to display a superimposed image based on the synthesized image signal in the image display area 21.

In the Step S160, the drive circuit 80 drives the display panel 120 based on the control signal. The drive circuit 80 performs PWM control on the LEDs of the display panel 120 based on the control signal. The display panel 120 displays the first image having corrected luminance in the first display area 21A, and the second image having corrected luminance in the second display area 21B.

As described above, in the first embodiment, if luminance correction of the second image to be displayed in the second display area 21B by itself enables control such that power does not exceed the maximum power set by the user, the correction coefficient calculator 12 sets the first luminance correction coefficient to 1.0, and calculates only the second luminance correction coefficient. For example, if the second luminance correction coefficient is calculated to be 0.75, all of the LEDs in the second display area 21B light up with a duty ratio of 75%. Further, in that case, all of the LEDs in the first display area 21A light up with a duty ratio of 100%. As a result, in the entire image in the image display area 21, luminance of only the second image in the second display area 21B can be reduced to 75%. With such control, the display device 100 can reduce power consumption to target power consumption, without changing luminance of the first display area 21A.

(Effects)

As described above, the display device 100 displays an entire image in the image display area 21 including the first display area 21A for displaying a first image and the second display area 21B for displaying a second image. The display device 100 monitors an image signal. If the sum of pixel values of a display image is larger than a predetermined threshold value, the display device 100 preferentially corrects luminance of the second image signal to be displayed in the second display area 21B. Further, if luminance correction of the second display area 21B by itself cannot enable control to bring the sum of the pixel values of the display image to the predetermined threshold value or less, the display device 100 corrects luminance of the first display area 21A and luminance of the second display area 21B per frame. By making such luminance correction, the display device 100 performs control to bring the sum of pixel values to a predetermined threshold value or less, so as to perform control such that power consumption has a predetermined value or less.

Further, the display device 100 corrects luminance per frame, and therefore the correction is made instantly. The preferential and instant correction of the second display area 21B can prevent a user who is focusing on the first image displayed in the first display area from unnecessarily feeling the lowered brightness. Further, the display device 100 can reduce peak power. If the display device is used for a purpose requiring long operating time per day, a power-saving effect greater than that of related art is exerted.

If the display device corrects luminance of each of the first display area and the second display area at the same rate based on the sum of pixel values of the entire image display area, problems such as narrowing of a dynamic range in the entire image display area and clipping in output gradation of luminance are caused. Particularly when a still image is displayed, visual problems occur. By contrast, if an image displayed in the image display area is a moving image, such problems are less liable to be visually recognized even when luminance of the entire image display area is changed instantly or a dynamic range is narrowed. When the display device 100 is used for a monitoring purpose, in many cases, the most part of the display image is a still image, and a moving image is displayed in superimposition over a part of the still image. When the display device 100 displays a still image in the first display area 21A and a moving image in the second display area 21B, the display device 100 preferentially performs luminance correction control on the second display area 21B, thereby being capable of maintaining image quality of the still image. Further, the display device 100 can perform power consumption control while maintaining image quality of the still image.

To sum up the above, a display device 100 according to the first embodiment includes a display unit, and a luminance correction controller 10. The display unit includes an image display area 21 capable of individually displaying different images in a first display area 21A and a second display area 21B. The second display area 21B is set in a part of the image display area 21. The first display area 21A is a part of the image display area 21 except the second display area 21B. The display unit displays a first image in the first display area 21A and a second image in the second display area 21B to thereby sequentially display, per frame, an entire image in which the first image is superimposed by the second image in the image display area 21. The luminance correction controller 10 corrects luminance of the entire image per the frame. In the first embodiment, the display unit is a display panel 120. The luminance correction controller 10 includes a first luminance information calculator 11A, a second luminance information calculator 11B, a first correction coefficient calculator 12A, a second correction coefficient calculator 12B, a first correction calculator 13A, and a second correction calculator 13B. The first luminance information calculator 11A calculates luminance of the first image. The second luminance information calculator 11B calculates luminance of the second image. The first correction coefficient calculator 12A calculates a first luminance correction coefficient for correcting the luminance of the first image. The second correction coefficient calculator 12B calculates a second luminance correction coefficient for correcting the luminance of the second image. The first correction calculator 13A corrects the luminance of the first image by using the first luminance correction coefficient. The second correction calculator 13B corrects the luminance of the second image by using the second luminance correction coefficient. The display panel 120 displays the first image having the luminance corrected by the first correction calculator 13A in the first display area 21A, and displays the second image having the luminance corrected by the second correction calculator 13B in the second display area 21B.

With the configuration as above, the display device 100 can individually correct luminance of each of an image to be displayed in a part of the image display area 21 and an image to be displayed in an area except the part. The display device can perform power-saving control while reducing deterioration of image quality of the entire image.

If luminance correction of the second image to be displayed in the second display area 21B by itself enables control such that a value of current to flow through the display panel 120 is brought to a predetermined value of current or less, the display device 100 corrects only the luminance of the second image. If luminance correction of the second image by itself cannot enable control to bring a value of current to flow through the display panel 120 to a predetermined value of current or less, the display device 100 corrects, as well as the second image, luminance of the first image to be displayed in the first display area 21A. In this manner, the display device 100 can perform power-saving control to reduce deterioration of image quality of the entire image to be displayed in the image display area 21. For example, the display device 100 separately corrects a still image, in which deterioration is liable to be conspicuous, and a moving image, in which deterioration is not liable to be conspicuous, thus being capable of performing power control to make deterioration of image quality of the entire image to be displayed in the image display area 21 inconspicuous.

The first correction coefficient calculator 12A and the second correction coefficient calculator 12B of the display device 100 according to the first embodiment respectively individually calculate the first luminance correction coefficient corresponding to the luminance of the first image and the second luminance correction coefficient corresponding to the luminance of the second image such that the luminance of the entire image that is based on the luminance of the first image and the luminance of the second image is brought to predetermined luminance or less.

With the configuration as above, the display device 100 can individually correct luminance of each of an image to be displayed in a part of the image display area 21 and an image to be displayed in an area except the part.

The luminance correction controller 10 of the display device 100 according to the first embodiment gives priority to making the second correction coefficient calculator 12B calculate the second luminance correction coefficient over making the first correction coefficient calculator 12A calculate the first luminance correction coefficient so as to correct the luminance of the second image by using the preferentially calculated second luminance correction coefficient, to thereby perform control to bring the luminance of the entire image to the predetermined luminance or less.

With the configuration as above, the display device 100 can perform power-saving control to avoid reduction in gradations of a base image to be displayed in the first display area 21A to the extent possible, and to make deterioration of image quality inconspicuous. That is, the display device 100 can lower luminance of an image to be displayed in the second display area 21B without causing deterioration of image quality of the first display area 21A.

The second correction coefficient calculator 12B of the display device 100 according to the first embodiment calculates the second luminance correction coefficient such that the luminance of the entire image that is based on the luminance of the first image and the luminance of the second image is brought to predetermined luminance or less. The display panel 120 displays the second image having the luminance corrected by the second correction calculator 13B in the second display area 21B.

With the configuration as above, the display device 100 preferentially corrects the second image being an image to be displayed over the base image in superimposition, thereby being capable of performing power-saving control to make deterioration of image quality of the entire display panel 120 inconspicuous.

The second correction coefficient calculator 12B of the display device 100 according to the first embodiment calculates the second luminance correction coefficient such that the luminance of the second image is brought to predetermined minimum luminance or more.

With the configuration as above, even if correction of luminance of the second image is excessive, the display device 100 can avoid occurrence of clipping of output gradation and visual problems caused depending on images.

The first correction coefficient calculator 12A of the display device 100 according to the first embodiment calculates the first luminance correction coefficient such that the luminance of the entire image is brought to the predetermined luminance or less and that the luminance of the second image is brought to the predetermined minimum luminance or more. The display panel 120 displays the first image having the luminance corrected by the first correction calculator 13A in the first display area 21A, and displays the second image having the luminance corrected by the second correction calculator 13B in the second display area 21B.

With the configuration as above, if correction of the second display area 21B by itself can enable control to bring the luminance of the entire image to predetermined luminance or less, the display device 100 corrects only the second display area 21B. In contrast, if correction of the second display area 21B by itself cannot enable control to bring the luminance of the entire image to predetermined luminance or less, the display device 100 corrects luminance in both of the first display area 21A and the second display area 21B. In this manner, the display device 100 can perform power-saving control to make deterioration of image quality of the entire display panel 120 inconspicuous. Such configuration is effective in a case where, for example, a ratio of the area of the second display area 21B with respect to that of the first display area 21A is small and luminance correction in the second display area 21B by itself cannot enable control to bring luminance of the entire image to predetermined luminance or less.

The display panel 120 of the display device 100 according to the first embodiment includes a plurality of pixels 22 that are arrayed in a matrix pattern in the image display area 21. Each of the plurality of pixels 22 has a pixel value that corresponds to the luminance of the entire image that is based on an image signal. The first luminance information calculator 11A calculates, as the luminance of the first image, a sum of the pixel values of the plurality of pixels 22 included in the first display area 21A. The second luminance information calculator 11B calculates, as the luminance of the second image, a sum of the pixel values of the plurality of pixels 22 included in the second display area 21B. The first correction calculator 13A corrects the pixel values of the plurality of pixels 22 included in the first display area 21A by using the first luminance correction coefficient. The second correction calculator 13B corrects the pixel values of the plurality of pixels 22 included in the second display area 21B by using the second luminance correction coefficient.

With the configuration as above, the display device 100 can individually correct luminance of each of an image to be displayed in a part of the image display area 21 and an image to be displayed in an area except the part by correcting the pixel values.

Each of the plurality of pixels 22 of the display panel 120 of the display device 100 according to the first embodiment includes a plurality of light emitting elements that emit different respective colors. Lighting of each of the light emitting elements is controlled based on a duty ratio that corresponds to the pixel value. The correction calculator 13 corrects the duty ratio by using the first luminance correction coefficient or the second luminance correction coefficient.

With the configuration as above, even if the display device 100 is a full-color display device 100 capable of PWM control, the display device 100 can perform power-saving control to correct luminance of the moving image part while maintaining image quality of the still image part.

Second Embodiment

Figure 6:
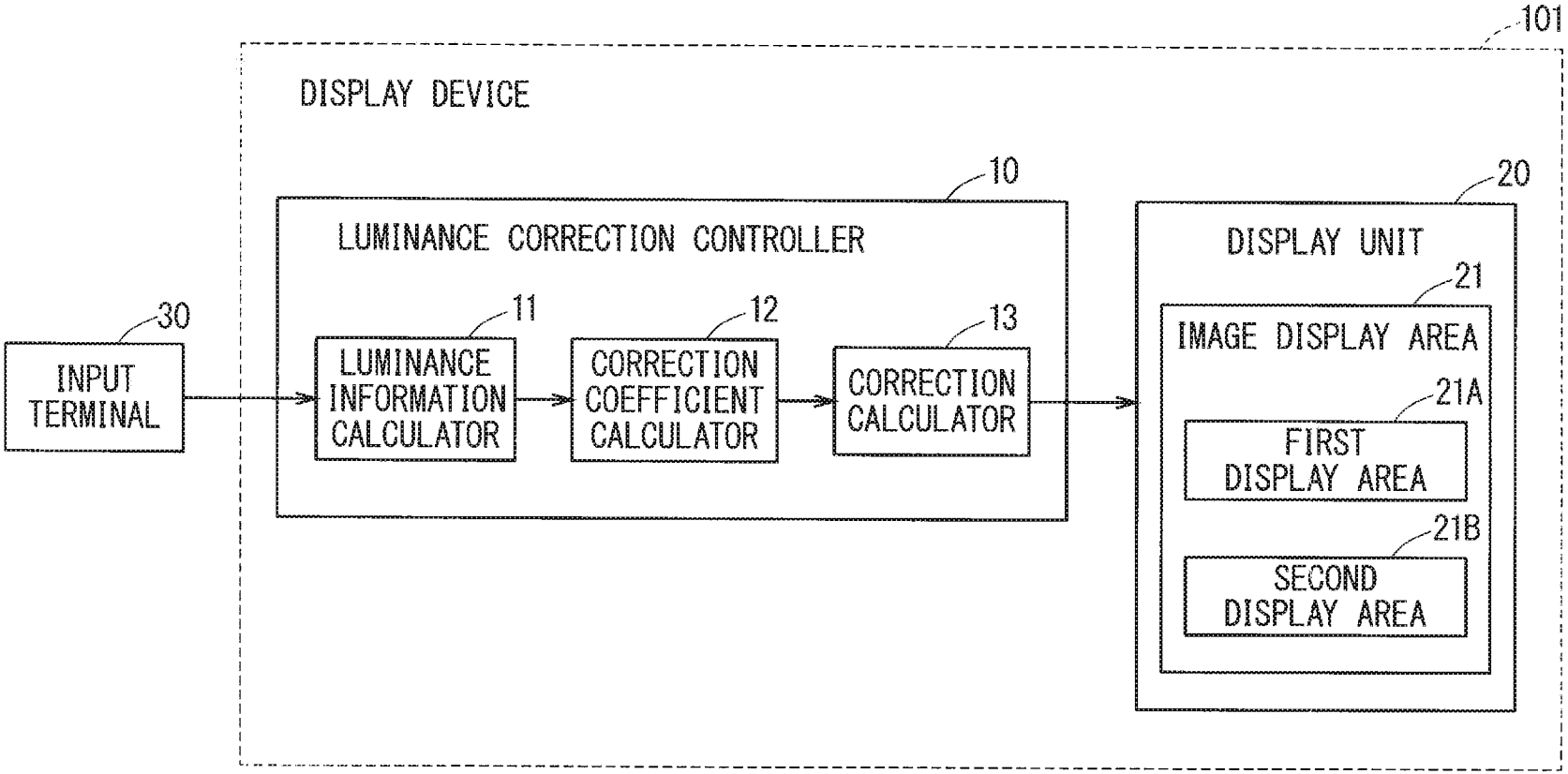
FIG. 6 is a functional block diagram showing configuration of a display device according to a second embodiment.

A display device 101 according to a second embodiment will be described. FIG. 6 is a functional block diagram showing configuration of the display device 101 according to the second embodiment. The display device 101 of the second embodiment includes a luminance correction controller 10 and a display unit 20.

The display unit 20 has a similar configuration as a configuration of the display panel 120 described in the first embodiment.

The luminance correction controller 10 includes a luminance information calculator 11, a correction coefficient calculator 12, and a correction calculator 13.

The luminance information calculator 11 calculates luminance of a first image and luminance of a second image based on an image signal input via an input terminal 30.

The correction coefficient calculator 12 calculates a second luminance correction coefficient for correcting luminance of the second image such that luminance of the entire image that is based on luminance of the first image and luminance of the second image is brought to predetermined luminance or less.

The correction calculator 13 corrects luminance of the second image by using the second luminance correction coefficient. In the second embodiment, the correction calculator 13 corrects luminance of the second image by multiplying each pixel value of a case of displaying the second image by the second luminance correction coefficient. Note that, the luminance correction processing performed by the correction calculator 13 is one example, and is not limited to the above.

The display unit 20 displays the second image having luminance corrected by the correction calculator 13 in the second display area 21B.

(Processing Circuit)

Figure 7:
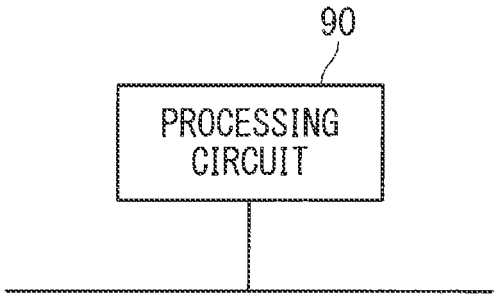
FIG. 7 is a diagram showing one example of a processing circuit of a luminance correction controller according to the second embodiment.

FIG. 7 is a diagram showing one example of a processing circuit 90 of the luminance correction controller 10. Functions of each of the luminance information calculator 11, the correction coefficient calculator 12, and the correction calculator 13 are implemented by the processing circuit 90. That is, the processing circuit 90 includes the luminance information calculator 11, the correction coefficient calculator 12, and the correction calculator 13.

If the processing circuit 90 is dedicated hardware, the processing circuit 90 is, for example, a single circuit, a composite circuit, a programmed processor, a programmed processor for parallel programming, an application specific integrated circuit (ASIC), a field-programmable gate array (FPGA), a circuit combining these elements, or the like. The functions of each of the luminance information calculator 11, the correction coefficient calculator 12, and the correction calculator 13 may be individually implemented by a plurality of processing circuits, or may be collectively implemented by a single processing circuit.

Figure 8:
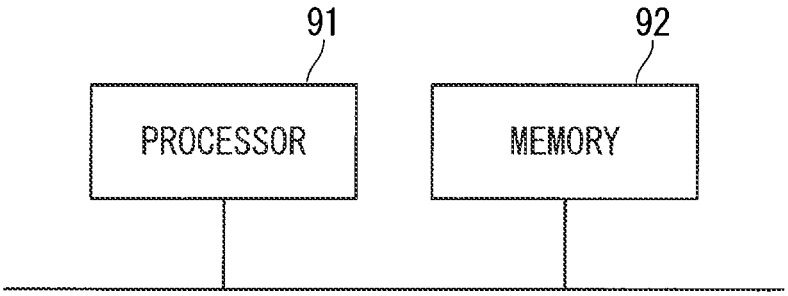
FIG. 8 is a diagram showing another example of a processing circuit of the luminance correction controller according to the second embodiment.

FIG. 8 is a diagram showing another example of a processing circuit of the luminance correction controller 10. The processing circuit includes a processor 91 and a memory 92. Functions of each of the luminance information calculator 11, the correction coefficient calculator 12, and the correction calculator 13 are implemented by the processor 91 executing a program stored in the memory 92. For example, the functions are implemented by the processor 91 executing software or firmware described as a program. That is, the luminance correction controller 10 includes the memory 92 to store a program, and the processor 91 to execute the program.

The program has description of functions of the luminance correction controller 10 calculating luminance of a first image and luminance of a second image based on an input image signal, calculating a second luminance correction coefficient for correcting luminance of the second image such that luminance of the entire image that is based on luminance of the first image and luminance of the second image is brought to predetermined luminance or less, correcting luminance of the second image by using the second luminance correction coefficient, and outputting a second image signal for displaying the second image having luminance corrected by the second luminance correction coefficient in the second display area 21B. Further, the program makes a computer execute a procedure and a method of the luminance information calculator 11, the correction coefficient calculator 12, and the correction calculator 13.

The processor 91 is, for example, a central processing unit, a processing unit, an arithmetic unit, a microprocessor, a microcomputer, a digital signal processor (DSP), or the like. The memory 92 is, for example, a non-volatile or volatile semiconductor memory such as random access memory (RAM), read only memory (ROM), flash memory, erasable programmable read only memory (EPROM), and electrically erasable programmable read only memory (EEPROM). Alternatively, the memory 92 may be any recording medium to be used henceforth, such as a magnetic disk, a flexible disk, an optical disc, a compact disc, a MiniDisc, and a DVD.

The above-mentioned functions of each of the luminance information calculator 11, the correction coefficient calculator 12, and the correction calculator 13 may be partly implemented by dedicated hardware, and may also be partly implemented by software or firmware. In this manner, the processing circuit implements the above-mentioned functions with hardware, software, firmware, or a combination of these.

(Luminance Correction Control)

Figure 9:
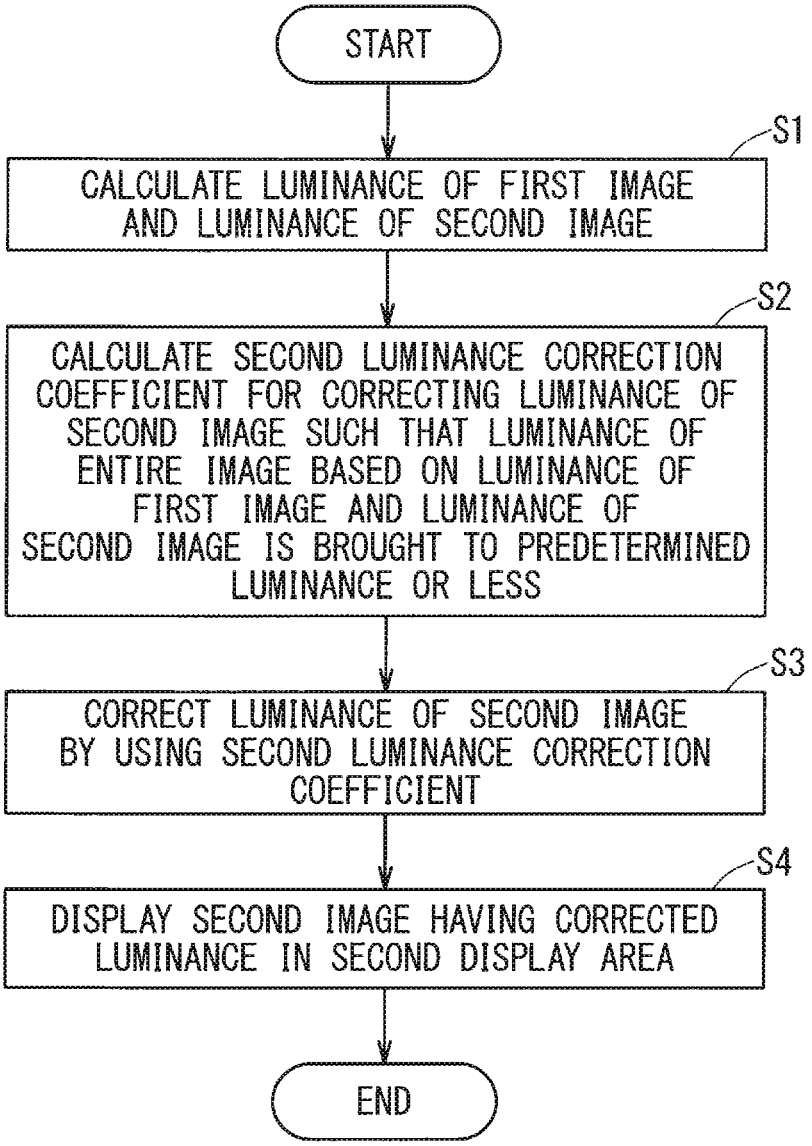
FIG. 9 is a flowchart showing operation of luminance correction control of the display device according to the second embodiment.

FIG. 9 is a flowchart showing luminance correction control of the display device 101 according to the second embodiment.

In Step S1, the luminance information calculator 11 calculates luminance of a first image and luminance of a second image based on an image signal input via an input terminal 30.

In Step S2, the correction coefficient calculator 12 calculates a second luminance correction coefficient for correcting luminance of the second image such that luminance of the entire image that is based on luminance of the first image and luminance of the second image is brought to predetermined luminance or less.

In Step S3, the correction calculator 13 corrects luminance of the second image by using the second luminance correction coefficient. In this case, the correction calculator 13 corrects luminance of the second image by multiplying each pixel value of a case of displaying the second image by the second luminance correction coefficient.

In Step S4, the display unit 20 displays the second image having luminance corrected by the correction calculator 13 in the second display area 21B.

(Effects)

To sum up the above, a display device 101 according to the second embodiment includes a display unit 20, and a luminance correction controller 10. The display unit 20 includes an image display area 21 capable of individually displaying different images in a first display area 21A and a second display area 21B. The second display area 21B is set in a part of the image display area 21. The first display area 21A is a part of the image display area 21 except the second display area 21B. The display unit 20 displays a first image in the first display area 21A and a second image in the second display area 21B to thereby sequentially display, per frame, an entire image in which the first image is superimposed by the second image in the image display area 21. The luminance correction controller 10 corrects luminance of the entire image per the frame. The luminance correction controller 10 includes a luminance information calculator 11, a correction coefficient calculator 12, and a correction calculator 13. The luminance information calculator 11 calculates luminance of the first image and luminance of the second image based on an input image signal. The correction coefficient calculator 12 calculates a second luminance correction coefficient for correcting the luminance of the second image such that the luminance of the entire image that is based on the luminance of the first image and the luminance of the second image is brought to predetermined luminance or less. The correction calculator 13 corrects the luminance of the second image by using the second luminance correction coefficient. The display unit 20 displays the second image having the luminance corrected by the correction calculator 13 in the second display area 21B.

According to the configuration as above, the display device 101 preferentially performs luminance correction control on the second image to be displayed in the second display area 21B. When the display device 101 displays a still image in the first display area 21A and a moving image in the second display area 21B, the display device 101 can correct the luminance of the entire image to be brought to predetermined luminance or less while maintaining image quality of the still image. As a result, the display device 101 can reduce power consumption while maintaining image quality of the still image.

Further, the program executed by the processing circuit in the second embodiment may further has description of a function of calculating a second luminance correction coefficient to bring luminance of the second image to predetermined minimum luminance or more. Further, the program may further has description of functions of calculating a first luminance correction coefficient such that luminance of the entire image is brought to predetermined luminance or less and that luminance of the second image is brought to predetermined minimum luminance or more, outputting a first image signal for displaying the first image having corrected luminance in the first display area 21A, and outputting a second image signal for displaying the second image having corrected luminance in the second display area 21B. The display device 101 of the second embodiment having such configuration provides effects similar to those of the display device 100 of the first embodiment.

Note that, in the present invention, each of the embodiments may be freely combined, and each of the embodiments may be modified or omitted as appropriate within the scope of the invention.

While the invention has been shown and described in detail, the foregoing description is in all aspects illustrative and not restrictive. It is therefore understood that numerous unillustrated modifications and variations can be devised without departing from the scope of the invention.

EXPLANATION OF REFERENCE SIGNS

10 luminance correction controller, 11 luminance information calculator, 11A first luminance information calculator, 11B second luminance information calculator, 12 correction coefficient calculator, 12A first correction coefficient calculator, 12B second correction coefficient calculator, 13 correction calculator, 13A first correction calculator, 13B second correction calculator, 20 display unit, 21 image display area, 21A first display area, 21B second display area, 22 pixel, 100 display device, 110 luminance correction control circuit, 120 display panel

The invention claimed is:

1. A display device comprising:

a display unit comprising an image display area capable of individually displaying different images in a first display area and a second display area, the second display area being set in a part of the image display area, the first display area being a part of the image display area except the second display area, the display unit displaying a first image in the first display area and a second image in the second display area to thereby sequentially display, per frame, an entire image in which the first image is superimposed by the second image in the image display area; and a luminance correction controller to correct luminance of the entire image per the frame, wherein the luminance correction controller includes a first luminance information calculator to calculate luminance of the first image, a second luminance information calculator to calculate luminance of the second image, a correction coefficient calculator comprising a first correction coefficient calculator to calculate a first luminance correction coefficient for correcting the luminance of the first image; and a second correction coefficient calculator to calculate a second luminance correction coefficient for correcting the luminance of the second image, a first correction calculator to correct the luminance of the first image by using the first luminance correction coefficient, and a second correction calculator to correct the luminance of the second image by using the second luminance correction coefficient, the correction coefficient calculator performs a determination whether a sum of the luminance of the first image and a predetermined lower-limit value on the luminance of the second image is less than or equal to a predetermined upper-limit value on luminance of the entire image that is based on the luminance of the first and second images, the first correction coefficient calculator and the second correction coefficient calculator respectively and individually calculate, based on the determination result, the first luminance correction coefficient corresponding to the luminance of the first image and the second luminance correction coefficient corresponding to the luminance of the second image such that the luminance of the entire image is brought to the predetermined upper-limit value or less, the luminance correction controller gives priority to making the second correction coefficient calculator calculate the second luminance correction coefficient over making the first correction coefficient calculator calculate the first luminance correction coefficient so as to correct the luminance of the second image by using the preferentially calculated second luminance correction coefficient, to thereby perform control to bring the luminance of the entire image to the predetermined upper-limit value or less, and the display unit displays the first image having the luminance corrected by the first correction calculator in the first display area, and displays the second image having the luminance corrected by the second correction calculator in the second display area.

2. The display device according to claim 1, wherein the display unit comprises a plurality of pixels that are arrayed in a matrix pattern in the image display area, each of the plurality of pixels has a pixel value that corresponds to the luminance of the entire image, the first luminance information calculator calculates, as the luminance of the first image, a sum of the pixel values of the plurality of pixels included in the first display area, the second luminance information calculator calculates, as the luminance of the second image, a sum of the pixel values of the plurality of pixels included in the second display area, the first correction calculator corrects the pixel values of the plurality of pixels included in the first display area by using the first luminance correction coefficient, and the second correction calculator corrects the pixel values of the plurality of pixels included in the second display area by using the second luminance correction coefficient.

3. The display device according to claim 2, wherein each of the plurality of pixels includes a plurality of light emitting elements that emit different respective colors, lighting of each of the light emitting elements is controlled based on a duty ratio that corresponds to the pixel value, and the first correction calculator corrects the duty ratio by using the first luminance correction coefficient or the second correction calculator corrects the duty ratio by using the second luminance correction coefficient.

4. A display device comprising:

a display unit comprising an image display area capable of individually displaying different images in a first display area and a second display area, the second display area being set in a part of the image display area, the first display area being a part of the image display area except the second display area, the display unit displaying a first image in the first display area and a second image in the second display area to thereby sequentially display, per frame, an entire image in which the first image is superimposed by the second image in the image display area; and a luminance correction controller to correct luminance of the entire image per the frame, wherein the luminance correction controller includes a first luminance information calculator to calculate luminance of the first image, a second luminance information calculator to calculate luminance of the second image, a correction coefficient calculator comprising a first correction coefficient calculator to calculate a first luminance correction coefficient for correcting the luminance of the first image and a second correction coefficient calculator to calculate a second luminance correction coefficient for correcting the luminance of the second image, a first correction calculator to correct the luminance of the first image by using the first luminance correction coefficient, and a second correction calculator to correct the luminance of the second image by using the second luminance correction coefficient, the correction coefficient calculator performs a determination whether a sum of the luminance of the first image and a predetermined lower-limit value on the luminance of the second image is less than or equal to a predetermined upper-limit value on luminance of the entire image that is based on the luminance of the first and second images, the second correction coefficient calculator calculates, based on the determination result, the second luminance correction coefficient such that the luminance of the entire image is brought to the predetermined upper-limit value or less, and the luminance of the second image is brought to the predetermined lower-limit value or more, the first correction coefficient calculator calculates based on the determination result, the first luminance correction coefficient such that the luminance of the entire image is brought to the predetermined upper-limit value or less and the luminance of the second image is brought to the predetermined lower-limit value or more, and the display unit displays the first image having the luminance corrected by the first correction calculator in the first display area, and displays the second image having the luminance corrected by the second correction calculator in the second display area.

5. The display device according to claim 4, wherein the display unit comprises a plurality of pixels that are arrayed in a matrix pattern in the image display area, each of the plurality of pixels has a pixel value that corresponds to the luminance of the entire image, the first luminance information calculator calculates, as the luminance of the first image, a sum of the pixel values of the plurality of pixels included in the first display area, the second luminance information calculator calculates, as the luminance of the second image, a sum of the pixel values of the plurality of pixels included in the second display area, the first correction calculator corrects the pixel values of the plurality of pixels included in the first display area by using the first luminance correction coefficient, and the second correction calculator corrects the pixel values of the plurality of pixels included in the second display area by using the second luminance correction coefficient.

6. The display device according to claim 5, wherein each of the plurality of pixels includes a plurality of light emitting elements that emit different respective colors, lighting of each of the light emitting elements is controlled based on a duty ratio that corresponds to the pixel value, and the first correction calculator corrects the duty ratio by using the first luminance correction coefficient or the second correction calculator corrects the duty ratio by using the second luminance correction coefficient.

* * * * *